US009980060B2

(12) United States Patent
Nielsen et al.

(10) Patent No.: US 9,980,060 B2
(45) Date of Patent: May 22, 2018

(54) BINAURAL HEARING AID DEVICE

(71) Applicant: OTICON A/S, Smørum (DK)

(72) Inventors: Claus Nielsen, Smørum (DK); Lars Bramsløw, Smørum (DK); Bo Westergård, Smørum (DK); Niels Søgaard Jensen, Allerød (DK); Filip Marchman Rønne, København N (DK); Carsten Borg, Smørum (DK)

(73) Assignee: OTICON A/S, Smørum (DK)

( * ) Notice: Subject to any disclaimer, the term of this patent is extended or adjusted under 35 U.S.C. 154(b) by 0 days. days.

(21) Appl. No.: 15/667,207

(22) Filed: Aug. 2, 2017

(65) Prior Publication Data

US 2018/0041848 A1 Feb. 8, 2018

(30) Foreign Application Priority Data

Aug. 3, 2016 (EP) ..... 16182496

(51) Int. Cl.
*H04R 5/00* (2006.01)
*H04R 25/00* (2006.01)
*H04S 7/00* (2006.01)

(52) U.S. Cl.
CPC ..... *H04R 25/552* (2013.01); *H04R 25/405* (2013.01); *H04R 25/505* (2013.01); (Continued)

(58) Field of Classification Search
CPC .. H04R 25/552; H04R 25/405; H04R 25/505; H04R 25/554
See application file for complete search history.

(56) References Cited

U.S. PATENT DOCUMENTS 7,881,486 B1 * 2/2011 Killion ..... H04R 25/402 381/313
8,687,833 B2 4/2014 Probst et al.
(Continued)

FOREIGN PATENT DOCUMENTS

EP 0 932 324 A2 7/1999
EP 1 933 589 A1 6/2008
EP 2 819 437 A1 12/2014

*Primary Examiner* — Simon King
(74) *Attorney, Agent, or Firm* — Birch Stewart Kolasch & Birch, LLP

(57) ABSTRACT

The invention relates to a binaural hearing aid device, comprising a first hearing aid and a second hearing aid, respectively. Each hearing aid comprises a microphone unit, a receiver unit, an audio processor and a speaker unit. The microphone unit is configured to receive an acoustic front tone, indicative of a front part of a surround sound, and to convert the acoustic front tone into an electric front signal. The receiver unit is configured to receive a wireless rear communication signal, indicative of a rear part of the surround sound, and to convert the rear communication signal into an electric rear signal. The audio processor is configured to receive the electric front signal and the electric rear signal and to determine a processed electric rear signal with respect to the electric front signal, by adjusting a time delay between the electric rear signal and the electric front signal and by adjusting a sound level of the electric rear signal according to a sound level of the electric front signal, wherein the audio processor of the first hearing aid is configured to adjust the time delay and the sound level of the electric rear signal differently than the audio processor of the second hearing aid, such that the combined acoustic output of the first hearing aid and of the second hearing aid form the rear part of the surround sound.

20 Claims, 4 Drawing Sheets

(52) U.S. Cl.
CPC ..... *H04R 25/554* (2013.01); *H04R 25/604* (2013.01); *H04S 7/30* (2013.01); *H04R 2460/11* (2013.01); *H04S 2420/01* (2013.01)

(56) References Cited

U.S. PATENT DOCUMENTS

| | | | | |
|---|---|---|---|---|
| 2009/0052703 | A1 | 2/2009 | Hammershoi | |
| 2012/0020485 | A1 | 1/2012 | Visser et al. | |
| 2013/0070945 | A1 | 3/2013 | Fusakawa et al. | |
| 2015/0189449 | A1 | 7/2015 | Udesen | |
| 2016/0112811 | A1* | 4/2016 | Jensen ..... | H04R 5/033 381/17 |

* cited by examiner

BINAURAL HEARING AID DEVICE

TECHNICAL FIELD

The disclosure relates to a binaural hearing aid device. Furthermore, the disclosure relates to a hearing system, to an audio surround system and to a method for providing a surround sound to the ears of a user.

BACKGROUND

Hearing aid devices that receive wireless audio signals by audio streaming devices are known. Thereby the hearing aid device provides a reproduction of acoustic sounds of audio devices, such as TV sets or music entertainment systems, that are connected to the audio streaming device and that usually require a plurality of loudspeakers. The hearing experience of hearing impaired users of such hearing aid devices is often disappointing since many of the spatial cues, included in the acoustic sounds usually provided by the loudspeakers are destroyed by the hearing aids.

WO 2010/043223 A1 describes a hearing aid system comprising means for receiving a multi-channel digitally encoded audio signal and means for rendering said received multi-channel signal into a binaural stereo signal. This document further describes a method for replaying audio streams in hearing aids.

U.S. Pat. No. 8,649,538 B2 describes a multi-mode hearing aid that includes a processor that is configured to selectively apply different hearing aid profiles to different input signals, such as a first sound signal received from a transceiver, to produce first and second shaped output signals. The described processor is configured to produce an output signal including at least one of the first shaped output signal and the second shaped output signal.

SUMMARY

It is an object of the disclosure to provide an improved binaural hearing aid device.

According to a first aspect, the disclosure relates to a binaural hearing aid device, comprising a first hearing aid adapted to be worn in or on a left ear of a user of the binaural hearing aid device and a second hearing aid, adapted to be worn in or on a right ear of the user of the binaural hearing aid device, respectively. Each hearing aid comprises a microphone unit, a receiver unit, an audio processor and a speaker unit.

The microphone unit is arranged and configured to receive an acoustic front tone, indicative of a front part of a surround sound, and to convert the acoustic front tone into an electric front signal.

The receiver unit may be configured to receive a wireless rear communication signal, indicative of a rear part of the surround sound, and to convert the rear communication signal into an electric rear signal.

The audio processor may be configured to receive the electric front signal and the electric rear signal and to determine a processed electric rear signal with respect to the electric front signal, by adjusting a time delay between the electric rear signal and the electric front signal and by adjusting a sound level of the electric rear signal according to a sound level of the electric front signal, and to provide a processed surround signal, comprising at least the processed electric rear signal.

The speaker unit may be configured to receive the processed surround signal, to convert the processed surround signal into an acoustic output and to provide in case of use the acoustic output to the respective ear of the user.

Furthermore, the audio processor of the first hearing aid may be configured to adjust the time delay and the sound level of the electric rear signal differently than the audio processor of the second hearing aid, such that the combined acoustic output of the first hearing aid and of the second hearing aid forms the rear part of the surround sound.

The binaural hearing aid device according to the first aspect of the disclosure does advantageously provide the rear part of the surround sound without requiring multiple stationary loudspeakers. This means that the listener can listen to surround sound without buying additional loudspeakers, and furthermore does not need to take speaker placement into consideration when furnishing the living room.

The binaural hearing aid device allows a continuous or dynamical adjustment of the electric rear signal performed by the audio processor. Thereby, the binaural hearing aid device is able to adapt the processing with respect to a spatial position of the user of the binaural hearing aid device or with respect to a movement of the user's head. Thereby, the user will experience an optimal surround sound experience no matter of his/hers position in front of the television.

Since the rear part of the surround sound provided by the binaural hearing aid device is not reflected by walls, furniture or other objects of the user's environment, the quality of the acoustic output provided to the respective ear of the user can be improved compared to acoustic tones that receive the user's ear after being provided by loudspeakers arranged around the user.

A further advantage is that the wireless rear communication signal can be provided for multiple users at the same time. This is particularly advantageous since the well known surround system comprising multiple loudspeakers offers just a very small spatial area of perfect surround sound, while people outside this spatial area perceive a sound signal with less quality. Furthermore, this allows a group of people to receive the rear part of the surround sound, while other people without the binaural hearing aid device just perceive the acoustic front tone. In that way, the binaural hearing aid devise can also serve as means to distinguish between two groups of people receiving sounds of two different qualities.

The first and second hearing aids might be any kind of hearing aid types, such as a Behind-The-Ear (BTE) type, an In-The-Ear (ITE) type, an In-The.Canal (ITC) type, or a Completely-In-The-Canal (CIC) type. The first and second hearing aids according to the disclosure could also be bone anchored hearing aids or cochlear implants.

The front part of the surround sound is the part that is to be provided at front loudspeakers for allowing a surround sound experience of the user in a loudspeaker based surround sound system, while the rear part of the surround sound is the part that is to be provided at rear loudspeakers for allowing a surround sound experience of the user. Typically, the rear part comprises mainly high frequencies above 1 kHz, while the front part comprises mainly low frequencies below 1 kHz.

The first and second hearing aid may each comprise a vent forming an acoustic sound passage for feeding external sounds to a respective eardrum of the user. This is particularly advantageous, since the front signal comprises mainly low-frequency information below 1 kHz, as for instance provided by a sub-woofer, which is perceivable for most of the hearing impaired users. Furthermore, the human ear is not able to distinguish any directional information at such low frequencies, so that the location of respective loudspeakers providing the acoustic front sound in front of the user of the binaural hearing aid device is not important. Therefore, the binaural hearing aid device circumvents the problem of buying rear loudspeakers and placing them at the right location, while allowing the user to have a natural surround sound experience in the low frequency region and with the further frequency parts of the acoustic front tone. The open fitting of the first and second hearing aid due to the vents lead to a reduced perception of the acoustic front tone depending on the vent size. However, since the low frequencies do not provide directional information, this reduced perception will not have a large influence on a quality of the provided surround sound. Furthermore, the use of vents allows further external sounds to enter the ear of the user, which enhances a wearing comfort of the binaural hearing aid device in view of a natural hearing experience. In one variant, just one of the first and second hearing aids comprises the vent, while the other hearing aid may be configured to further process the electric front signal, such that the acoustic output of the first hearing aid or of the second hearing aid forms a combination of the rear part and the front part of the surround sound.

The first hearing aid may receive the front signal and transmit the front signal via a near field communication link or a Bluetooth link to the second hearing aid, wherein the transmitted front signal is optimized with respect to delay and sound level. Thereby, the user will experience an even more improved surround sound experience.

The first and second hearing aid may each comprise a localizing unit, which is connected to the audio processor, and which is configured to receive a location information and to determine a distance between the respective hearing aid and a source of the acoustic front tone, and wherein the audio processor is further configured to adjust the electric rear signal according to the determined distance. The binaural hearing aid device advantageously allows a user to change his or her position with respect to the audio device that provides the surround sound. In contrast to usual loudspeaker arrangements, wherein an optimal configuration of a respective surround sound signal is provided at a specific position, the first and second hearing aids of the binaural hearing aid system of this embodiment will adapt the sound level and the time delay of the electric rear signal with respect to the actual position of the user, so that the user will experience an optimal surround sound experience no matter where the user is seating in front of a respective audio device.

The microphone unit of the first and/or second hearing aid may comprise a directional microphone, preferably a respective microphone array, which is arranged and configured to determine and provide the location information, or wherein the localizing unit is further configured to receive and compare the electric front signal and the electric rear signal to determine a generic Head Related Transfer Function, and to determine the location information using the Head Related Transfer Function. In an example of this variant, the microphone array forms a steered beamformer that allows to measure a distance between the respective microphone array and an audio streaming device that has transmitted the acoustic front tone. The Head Related Transfer Function (HRTF) is the transfer function that describes the transfer of the acoustic front signal from a respective loudspeaker, preferable from a first and a second front loudspeaker, to the respective ear drum of the user. Such a HRTF is individual for each listener, but in practise, generic HRTFs can be used for processing the electric rear signal, due to a large Interaural Level Difference (ILD) and Interaural Time Difference (ITD) for typical surround loudspeaker positions. In a further variant, the microphone unit of the first and/or second hearing aid comprises a receiver array for receiving the rear communication signal, which is configured to determine and provide the location information. Details for estimating location information in similar arrangement, in particular by using the HRTF or by using a microphone array, are well known.

The first and second hearing aids may comprise a respective detector unit, which is arranged and configured to detect a change of a position of the respective hearing aid and to initiate an adjustment of the electric rear signal upon a detection of a change of the position. In a variant, the detector unit comprises one or more of a gyroscope, an accelerometer, a compass, or a GPS receiver. The detector unit of this specific variant, reduces the frequency of adjustments needed for providing the rear part of the surround sound by allowing the audio processor to stay in a certain setting until the position of the respective hearing aid has changed. If the user changes a seating position or a position of the head, a change of a setting of the audio processor as a result of the adjustment of time delay and sound level of the electric rear signal is initiated for providing an optimal rear part of the surround sound. At least one of the first and second hearing aids comprises the detection unit, wherein the first and second hearing aid are further configured to exchange hearing aid communication signals, indicating the detection of a change of position by the detector unit.

The binaural hearing aid device is configured to adjust the setting of the audio processor continuously or dynamically for predetermined periods of time.

The processed surround signal may be a combination of the processed electric rear signal and the electric front signal, such that the acoustic output of the first hearing aid and of the second hearing aid each forms a combination of the rear part and the front part of the surround sound. By processing the electric front signal, the front signal can be adapted to a specific hearing impairment of the user. Furthermore, the front tone might be amplified or further adapted for improving the surround sound experience of the user of the binaural hearing aid device, which is particularly advantageous, if the binaural hearing aid device does not comprise a vent for allowing an acoustic sound passage to the eardrum of the user.

The first and second hearing aids may be further configured to change a processing configuration of the audio processor from a speech-mode to a stereo-sound-mode, upon a detection of the rear communication signal. The speech-mode is the normal hearing aid mode, wherein the hearing aid is configured to amplify an acoustic tone according to the hearing impairment of the user, while in the stereo-sound-mode of the respective hearing aid, the audio processor may be configured to compare electric front signal and electric rear signal for providing a processed signal.

According to a second aspect, the disclosure relates to a hearing system, comprising the binaural hearing aid device according to the first aspect of the disclosure and an audio streaming device, wherein the audio streaming device may be arranged and configured to receive rear sound data from an external audio device, to convert the rear sound data into the rear communication signal and to provide the rear communication signal wirelessly.

The hearing system according to the second aspect can be advantageously adapted to different external audio devices, since most of the known external audio devices have an acoustic output channel that can be connected to the audio streaming device. The connection between the external audio device, which does not form a part of the hearing system, and the audio streaming device is preferably a wired connection.

The rear communication signal is provided via a short range wireless link, such as a Bluetooth link, between the audio streaming device and the first and second hearing aid. Preferably, the wireless link is a Bluetooth low energy link. In a further variant, the wireless link is formed by a streamer gateway that allows a plurality of users to be wirelessly connected to the audio streaming device at the same time.

The audio streaming device is for instance a TV box connected to a television, wherein the TV box is configured to stream the audio from the television to the hearing aids via the short range wireless link. In an alternative variant, the audio streaming device is adapted to communicate with a certain type of hearing aid by using predefined signal components that help to reduce a signal size of the rear communication signal.

The hearing system may further comprise at least one front loudspeaker, and wherein the audio streaming device may further be configured to receive front sound data from the external audio device and to transmit the front sound data to the at least one front loudspeaker, and wherein the front loudspeaker may be configured to convert the front sound data into the acoustic front tone. Preferably, the hearing system comprises at least two front loudspeakers. Using two loudspeakers for providing the acoustic front tone allows a determination of the location information by evaluating a phase difference between sounds that receive at the respective hearing aid of the binaural hearing aid device, while a spatial distance between both loudspeakers is predefined. In a further preferred variant, the audio streaming device may be connected to a loudspeaker that provides a sub-woofer channel of the surround sound, comprising just frequency cues for frequencies below 1 kHz and therefore just low frequency information that is known to include no directional information for human ears. In a further variant, two loudspeakers provide the acoustic front tone, wherein a first loudspeaker provides a left sound channel and at least a part of a center sound channel and wherein a second loudspeaker provides a right sound channel and at least a further part of the center sound channel.

According to a third Aspect, the disclosure relates to an audio surround system, comprising the hearing system according to the second aspect of the disclosure and the external audio device, and wherein the external audio device is a TV set, a computer, or a music entertainment system.

In the audio surround system, the audio streaming device forms a part of the external audio device. The audio surround system comprises a plurality of loudspeakers, configured to provide the acoustic front tone. Preferably at least one of the loudspeakers may be configured to provide a center or sub-woofer channel, comprising just low frequency information about frequencies below 1 kHz.

According to a fourth aspect, the disclosure relates to a method for providing a surround sound to the ears of a user, comprising the steps of attaching a first hearing aid in or on a left ear of a user and a second hearing aid in or on a right ear of the user receiving an acoustic front tone, indicative of a front part of a surround sound, by the respective hearing aids and converting the acoustic front tone into an electric front signal;

receiving a wireless rear communication signal, indicative of a rear part of the surround sound, by the respective hearing aids and converting the rear communication signal into an electric rear signal;

determining a processed electric rear signal with respect to the electric front signal, by adjusting a time delay between the electric rear signal and the electric front signal and by adjusting a sound level of the electric rear signal according to a sound level of the electric front signal, and providing a processed surround signal, consisting at least of the processed electric rear signal;

converting the processed surround signal into an acoustic output and providing the acoustic output to the respective ear of the user, wherein the time delay and the sound level of the electric rear signal provided to the left ear is different from the time delay and the sound level of the electric rear signal provided to the right ear, such that the acoustic output of the first hearing aid and of the second hearing aid form the rear part of the surround sound.

Preferably at least some of the steps of this method are controlled by a computer program.

An activity of a hearing aid function that should be active as long as no front part or rear part of a surround sound has been provided, such as an amplification of received sounds, is controlled. This control of the activity of basic hearing aid functions is preferably provided by a further computer program. The method allows an automatic switch between a stereo-sound-mode and a speech-mode of the respective hearing aids that carry out this method The method further comprises a determining of a distance between the respective hearing aid and a source of the acoustic front tone, and wherein the adjustment of the electric rear signal is provided according to the determined distance.

The method further comprises a detection of a change of a position of the respective hearing aid and an initiation of the adjustment of the electric rear signal upon a detection of a change of the position.

The method according to the fourth aspect of the disclosure, the method further comprises as first step a providing of an acoustic front tone, and the further step of providing rear sound data, converting the rear sound data into the rear communication signal and providing the rear communication signal wirelessly. The order of both steps of this embodiment can be changed, depending on the surround signal that should be provided.

If a hearing aid user wants to listen to the radio the sound quality has to be good and without competing noise. Using a personal radio for entertainment is for some brands only possible by connecting the radio to an audio streaming device that will stream the sound to the hearing aids. This is a cumbersome solution that often might prevent people from listening to a personal radio.

A hearing aid system with built in radio (FM, DAB) will ensure that the sound is amplified tailored to the hearing loss. [If possible also internet radio over a wifi connection]. Simple operation of the radio functionality can be done by switches and controls on the hearing aid. On demand the user can get info on what is on the radio now by a short message from the RDS or DAB info e.g. 'you are listening to radio channel 3'. More advanced control of the radio functionality can be done by an app on the user's cell phone. Voice control of the radio could also be used.

In a Receiver-In-The-Ear (RITE) solution the speaker wire can be used as an antenna for the radio circuit. When the hearing aid is in 'radio mode' the gain of the system will be altered in such a way that the sound is externalized. The controlling of the radio by means of the hearing aid controls are limited to turn on and off and adjusting the volume of the radio. More sophisticated adjustment of the radio can be done by a cell phone app e.g. searching for and selecting a station or switching between FM and DAB. [When the user enters an area with wifi streaming radio signals the hearing aid radio system will offer the user to switch over to wifi radio]

There should be various ways of automatically switching off radio, e.g. if someone speaks to you or an announcement is coming from a public address (PA) system. This is important to avoid missing important information from the outside. A 'replay' function of previous microphone audio may also be useful to catch up on missed information.

A binaural hearing aid system, comprising a first hearing aid adapted to be worn in or on a left ear of a user of the binaural hearing aid system and a second hearing aid, adapted to be worn in or on a right ear of the user of the binaural hearing aid system, and an audio streaming device respectively, wherein each hearing aid comprises a microphone unit, arranged and configured to receive an acoustic front tone from the audio streaming device, indicative of a front part of a surround sound, and to convert the acoustic front tone into an electric front signal;

a receiver unit, configured to receive a wireless rear communication signal from the audio streaming device, indicative of a rear part of the surround sound, and to convert the rear communication signal into an electric rear signal;

an audio processor, configured to receive the electric front signal and the electric rear signal and to determine a processed electric rear signal with respect to the electric front signal, by adjusting a time delay between the electric rear signal and the electric front signal and by adjusting a sound level of the electric rear signal according to a sound level of the electric front signal, and to provide a processed surround signal, comprising at least the processed electric rear signal;

a speaker unit, configured to receive the processed surround signal, to convert the processed surround signal into an acoustic output and to provide in case of use the acoustic output to the respective ear of the user, wherein the audio processor of the first hearing aid is configured to adjust the time delay and the sound level of the electric rear signal differently than the audio processor of the second hearing aid, such that the combined acoustic output of the first hearing aid and of the second hearing aid forms the rear part of the surround sound.

A hearing system wherein the audio streaming device is arranged and configured to receive rear sound data from an external audio device, to convert the rear sound data into the rear communication signal and to provide the rear communication signal wirelessly to the first and second binaural hearing aid device.

A Method for providing a surround sound to the ears of a user, comprising the steps of attaching a first hearing aid in or on a left ear of a user and a second hearing aid in or on a right ear of the user receiving an acoustic front tone from an audio streaming device, indicative of a front part of a surround sound, by the respective hearing aids and converting the acoustic front tone into an electric front signal;

receiving a wireless rear communication signal from the audio streaming device, indicative of a rear part of the surround sound, by the respective hearing aids and converting the rear communication signal into an electric rear signal;

determining a processed electric rear signal with respect to the electric front signal, by adjusting a time delay between the electric rear signal and the electric front signal and by adjusting a sound level of the electric rear signal according to a sound level of the electric front signal, and providing a processed surround signal, consisting at least of the processed electric rear signal;

converting the processed surround signal into an acoustic output and providing the acoustic output to the respective ear of the user, wherein the time delay and the sound level of the electric rear signal provided to the left ear is different from the time delay and the sound level of the electric rear signal provided to the right ear, such that the acoustic output of the first hearing aid and of the second hearing aid form the rear part of the surround sound.

BRIEF DESCRIPTION OF DRAWINGS

The aspects of the disclosure may be best understood from the following detailed description taken in conjunction with the accompanying figures. The figures are schematic and simplified for clarity, and they just show details to improve the understanding of the claims, while other details are left out. Throughout, the same reference numerals are used for identical or corresponding parts. The individual features of each aspect may each be combined with any or all features of the other aspects. These and other aspects, features and/or technical effect will be apparent from and elucidated with reference to the illustrations described hereinafter in which:

DETAILED DESCRIPTION

Figure 1:
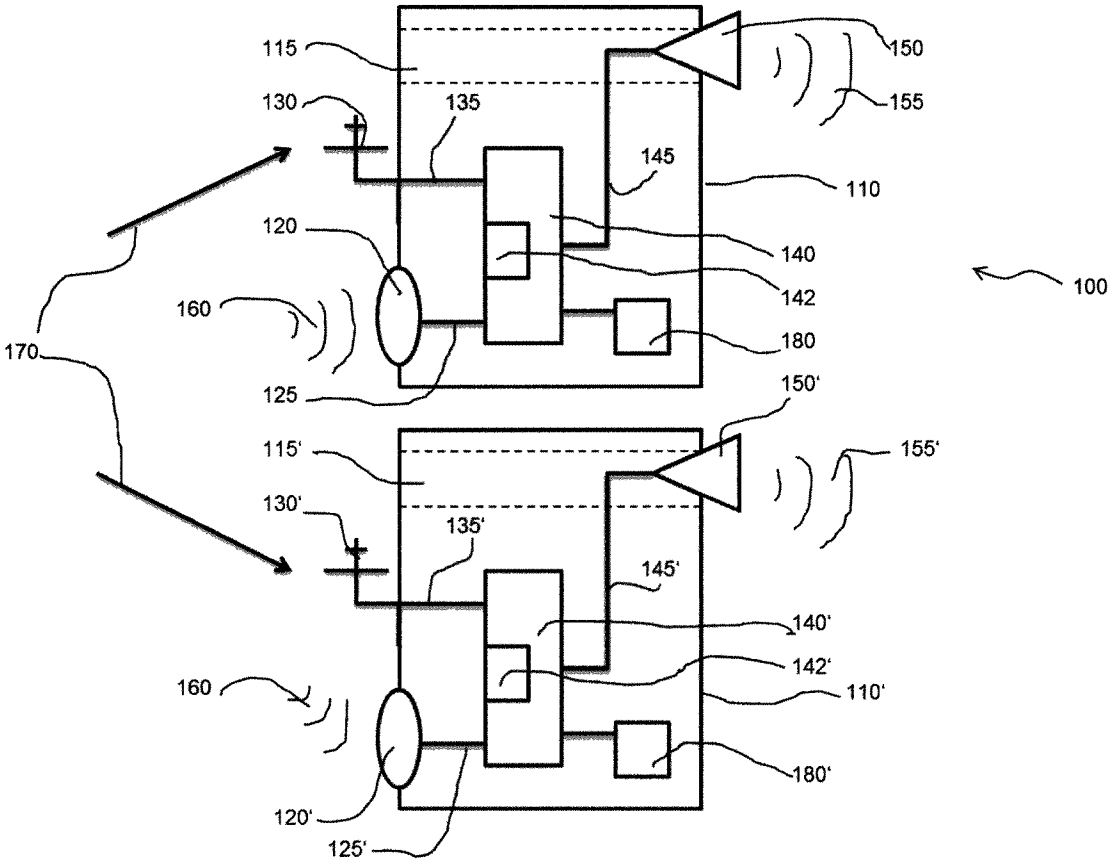
FIG. 1 illustrates an embodiment of a binaural hearing aid device according to a first aspect of the invention.

The detailed description set forth below in connection with the appended drawings is intended as a description of various configurations. The detailed description includes specific details for the purpose of providing a thorough understanding of various concepts. However, it will be apparent to those skilled in the art that these concepts may be practiced without these specific details. Several aspects of the apparatus and methods are described by various blocks, functional units, modules, components, circuits, steps, processes, algorithms, etc. (collectively referred to as "elements"). Depending upon particular application, design constraints or other reasons, these elements may be implemented using electronic hardware, computer program, or any combination thereof.

The electronic hardware may include microprocessors, microcontrollers, digital signal processors (DSPs), field programmable gate arrays (FPGAs), programmable logic devices (PLDs), gated logic, discrete hardware circuits, and other suitable hardware configured to perform the various functionality described throughout this disclosure. Computer program shall be construed broadly to mean instructions, instruction sets, code, code segments, program code, programs, subprograms, software modules, applications, software applications, software packages, routines, subroutines, objects, executables, threads of execution, procedures, functions, etc., whether referred to as software, firmware, middleware, microcode, hardware description language, or otherwise.

The hearing aid is adapted to be worn in any known way. This may include i) arranging a unit of the hearing aid behind the ear with a tube leading air-borne acoustic signals into the ear canal or with a receiver/loudspeaker arranged close to or in the ear canal such as in a Behind-the-Ear type hearing aid, and/or ii) arranging the hearing device entirely or partly in the pinna and/or in the ear canal of the user such as in a In-the-Ear type hearing aid or In-the-Canal/Completely-in-Canal type hearing aid, or iii) arranging a unit of the hearing aid attached to a fixture implanted into the skull bone such as in Bone Anchored Hearing Aid or Cochlear Implant, or iv) arranging a unit of the hearing device as an entirely or partly implanted unit such as in Bone Anchored Hearing Aid or Cochlear Implant.

A "hearing system" refers to a system comprising one or two hearing devices, disclosed in present description, and a "binaural hearing system" refers to a system comprising two hearing devices where the devices are adapted to cooperatively provide audible signals to both of the user's ears. The hearing system or binaural hearing system may further include auxiliary device(s) that communicates with at least one hearing device, the auxiliary device affecting the operation of the hearing devices and/or benefiting from the functioning of the hearing devices. A wired or wireless communication link between the at least one hearing device and the auxiliary device is established that allows for exchanging information (e.g. control and status signals, possibly audio signals) between the at least one hearing device and the auxiliary device. Such auxiliary devices may include at least one of remote controls, remote microphones, audio gateway devices, mobile phones, public-address systems, car audio systems or music players or a combination thereof. The audio gateway is adapted to receive a multitude of audio signals such as from an entertainment device like a TV or a music player, a telephone apparatus like a mobile telephone or a computer, a PC. The audio gateway is further adapted to select and/or combine an appropriate one of the received audio signals (or combination of signals) for transmission to the at least one hearing device. The remote control is adapted to control functionality and operation of the at least one hearing devices. The function of the remote control may be implemented in a SmartPhone or other electronic device, the SmartPhone/electronic device possibly running an application that controls functionality of the at least one hearing device.

In general, a hearing device includes i) an input unit such as a microphone for receiving an acoustic signal from a user's surroundings and providing a corresponding input audio signal, and/or ii) a receiving unit for electronically receiving an input audio signal. The hearing device further includes a signal processing unit for processing the input audio signal and an output unit for providing an audible signal to the user in dependence on the processed audio signal.

The input unit may include multiple input microphones, e.g. for providing direction-dependent audio signal processing. Such directional microphone system is adapted to enhance a target acoustic source among a multitude of acoustic sources in the user's environment. In one aspect, the directional system is adapted to detect (such as adaptively detect) from which direction a particular part of the microphone signal originates. This may be achieved by using conventionally known methods. The signal processing unit may include amplifier that is adapted to apply a frequency dependent gain to the input audio signal. The signal processing unit may further be adapted to provide other relevant functionality such as compression, noise reduction, etc. The output unit may include an output transducer such as a loudspeaker/receiver for providing an air-borne acoustic signal transcutaneously or percutaneously to the skull bone or a vibrator for providing a structure-borne or liquid-borne acoustic signal. In some hearing devices, the output unit may include one or more output electrodes for providing the electric signals such as in a Cochlear Implant.

Now referring to FIG. 1, which illustrates an embodiment of a binaural hearing aid device 100 according to a first aspect of the invention;

The binaural hearing aid device 100 comprises a first hearing aid 110 adapted to be worn in or on a left ear of a user of the binaural hearing aid device 100 and a second hearing aid 110', adapted to be worn in or on a right ear of the user of the binaural hearing aid device 100, respectively. Each hearing aid comprises a microphone unit 120, 120', a receiver unit 130, 130', an audio processor 140, 140' and a speaker unit 150, 150'.

The microphone unit 120, 120' is arranged and configured to receive an acoustic front tone 160, indicative of a front part of a surround sound, and to convert the acoustic front tone 160 into an electric front signal 125, 125'. In this embodiment, a single microphone is used in each microphone unit. The electric front signals 125 and 125' of the left and right hearing aid 110, 110' differ in view of different distances that the acoustic front tone 160 has passed. In an embodiment not shown, a directional microphone or a microphone array is used to gain further location information with respect to a position of the respective hearing aid.

The receiver unit 130, 130' is configured to receive a wireless rear communication signal 170, indicative of a rear part of the surround sound, and to convert the rear communication signal 170 into an electric rear signal 135, 135'. The receiver 130, 130' is formed by an antenna arrangement. The wireless rear communication signal is in the illustrated embodiment a Bluetooth low energy signal.

The audio processor 140, 140' is configured to receive the electric front signal 125, 125' and the electric rear signal 135, 135' and to determine a processed electric rear signal with respect to the electric front signal 125, 125', by adjusting a time delay between the electric rear signal 135, 135' and the electric front signal 125, 125' and by adjusting a sound level of the electric rear signal 135, 135' according to a sound level of the electric front signal 125, 125', and to provide a processed surround signal 145, 145', comprising at least the processed electric rear signal.

The speaker unit 150, 150' is configured to receive the processed surround signal 145, 145', to convert the processed surround signal 145, 145' into an acoustic output 155, 155' and to provide in case of use the acoustic output 155, 155' to the respective ear of the user.

Furthermore, the audio processor 140 of the first hearing aid 110 is configured to adjust the time delay and the sound level of the electric rear signal 135 differently than the audio processor 140' of the second hearing aid 110', such that the combined acoustic output of the first hearing aid 110 and of the second hearing aid 110' forms the rear part of the surround sound.

Both hearing aids 110, 110' comprise furthermore a vent 115, 115' formed by a respective bore through the hearing aid 110, 110. Thereby, each vent 115, 115' forms an acoustic sound passage for feeding external sounds to a respective eardrum of the user. This allows the user to directly hear the acoustic front tone 160 and thereby enhances a natural hearing experience.

The complete surround signal is perceived by the user of the binaural hearing aid device by a combined recognition of the acoustic front tone through the vents 115, 115' and of the provided acoustic output 155, 155' that is indicative of the processed electric rear signal. In variants of this embodiment, the acoustic output 155, 155' is also indicative of the electric front signal 125, 125'. In this variant, the processed surround signal 145, 145' comprises a combination of the processed electric rear signal and the electric front signal 125, 125'.

The first and second hearing aids 110, 110' of the binaural hearing aid device 100 further comprise a respective localizing unit 142, 142' that is connected to the respective audio processor 140, 140'. The localizing unit 142, 142' is configured to receive location information and to determine a distance between the respective hearing aid 110, 110' and a source of the acoustic front tone 160. In the embodiment shown in FIG. 1, the localizing unit 142, 142' receives the electric front signal 125, 125' and the electric rear signal 135, 135' and determines location information indicative of a distance between hearing aid and respective sound source that has provided the acoustic front tone, by using a generic Head Related Transfer Function. In other embodiments not shown, the localizing unit is connected to a directional microphone array and thereby estimates the distance via steered beamforming. By being able to measure the distance of the sound source, it is possible to adjust the time delay and the sound level of the electric rear signal 135, 135' accordingly.

Thereby an optimized processing configuration of the audio processor 140, 140' is accomplished, even if the user is moving the seating position or the head. The localizing unit 142, 142' allows a continuous or dynamical optimization of the binaural hearing aid device 100 to the motion of the user. In a variant of the shown embodiment, an adjustment performed by the audio processor 140, 140' is performed in dependence on the listening position of the user such that the time delay between electric rear signal and the electric front signal is between 5 and 15 ms if the listening position is close (smaller than 6 m) to the sound source of the acoustic front tone, and between 15 ms and 35 ms, if the listening position is far away from the sound source (more than 6 m distance).

In the illustrated embodiment, the first and second hearing aids 110, 110' furthermore comprise a respective detector unit 180, 180', which is arranged and configured to detect a change of a position of the respective hearing aid 110, 110' and to initiate an adjustment of the electric rear signal 130, 130' upon a detection of a change of the position. The detector unit 180, 180' comprises an accelerometer (not shown). The dynamical optimization enabled by the localizing unit 142, 142' is therefore just provided dynamically during a time period where a change of position of the user is detected by the detector unit 180, 180'. If no change of position of the user is detected for a predefined period of time, for instance less than 30 seconds, preferably less than 6 seconds, the determination of the distance by the localizing unit 142, 142' is deactivated and a present setting of the audio processor 140, 140' is maintained. In further embodiments not shown, the detector unit comprises a gyroscope, an accelerometer, a compass, or a GPS receiver or a combination thereof.

In a not shown embodiment of the binaural hearing aid device, a fixed location of the user while using the binaural hearing aid device is assumed. Therefore, a fixed adaptation of the sound level and the time delay is provided.

Figure 2:
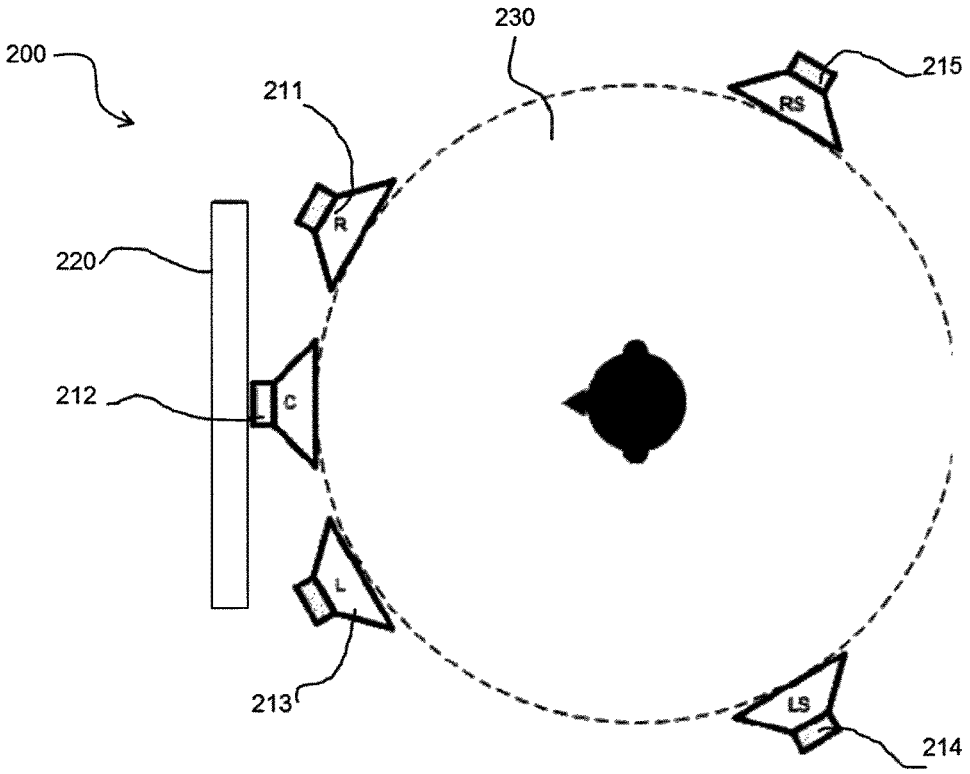
FIG. 2 illustrates an embodiment of a prior art hearing system that comprises a plurality of loudspeakers.

FIG. 2 illustrates an embodiment of a prior art hearing system 200 that comprises a plurality of loudspeakers 211, 212, 213, 214, 215.

The prior art hearing system 200 is connected to an external device 220, which is formed by a TV set. The user of the prior art hearing system 200 can hear acoustic signals provided by the loudspeakers 211, 212, 213, 214, 215 of the hearing system 200 within the illustrated circle 230. However, an optimal surround sound experience is just gained, if the user is in the centre of the circle 230.

The loudspeakers 211, 212, 213, 214, 215 are dived into two groups. The loudspeaker 214 and 215 are rear loudspeakers, which should be at a fixed position at a left side and a right side behind the user of the prior art hearing system 200 and configured to provide a rear part of the surround signal initially provided by the external device 220. The loudspeakers 211, 212 and 213 should be at a fixed position in front of the user and configured to provide the front part of the surround signal. In the illustrated embodiment of the prior art hearing system 200, the loudspeaker 212 is particularly configured to provide the center or sub-woofer channel, which just comprises low frequency information, i.e. frequency cues below 1 kHz.

Figure 3:
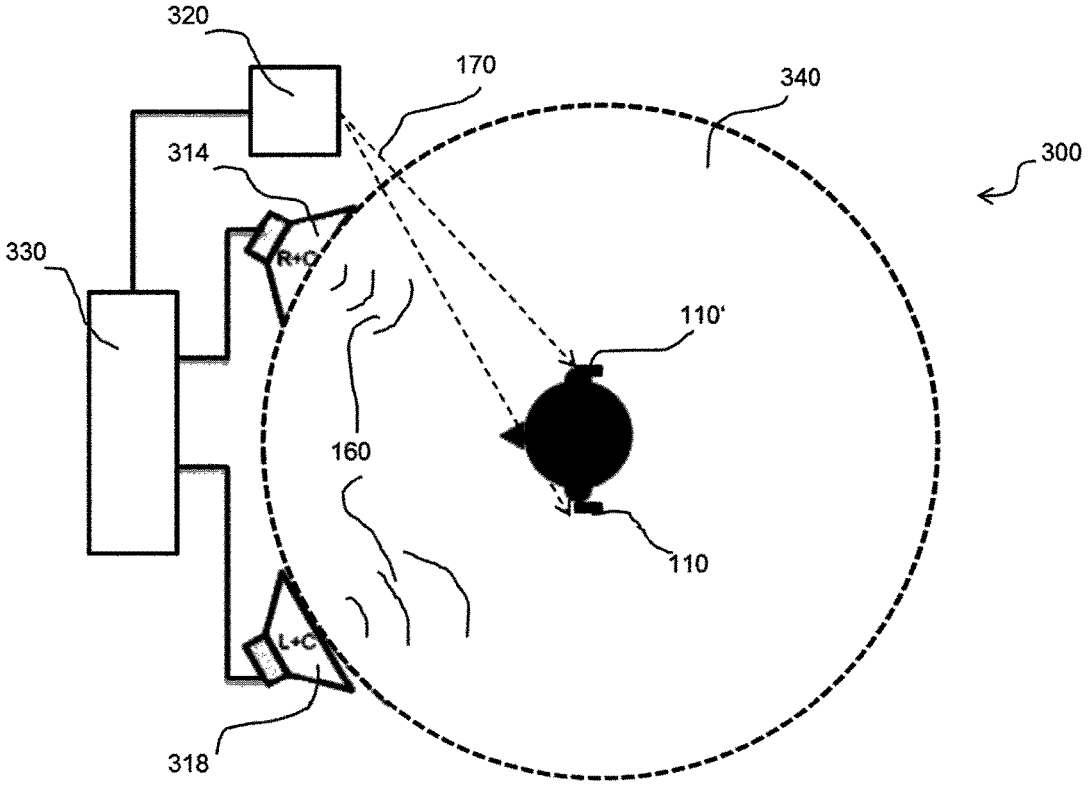
FIG. 3 illustrates an embodiment of a hearing system according to a second aspect of the invention.

FIG. 3 illustrates an embodiment of a hearing system 300 according to a second aspect of the invention.

The hearing system 300 comprises the hearing aids 110, 110' according to the embodiment shown in FIG. 1 and an audio streaming device 320. In this particular embodiment, the hearing system 300 furthermore comprises two loudspeakers 314, 318.

In contrast to the prior art hearing system 200 shown in FIG. 2, the hearing system 300 just comprises just the two loudspeakers 314, 318, located in front of the user. The first loudspeaker 314 provides a right sound channel and at least a part of a center sound channel and the second loudspeaker 318 provides a left sound channel and at least a further part of the center sound channel. The center sound channel mainly includes low frequency cues below 1 kHz, which are known to involve no distinguishable directional information for human ears.

Both loudspeakers 314, 318 are connected to the audio streaming device 320, which is configured to receive sound data, comprising front sound data, indicative of the front part of the surround sound, and rear sound data, indicative of the rear part of the surround sound. The loudspeakers 314, 318 are configured to convert the front sound data into the acoustic front tone 160. The sound data is transmitted to the audio streaming device 320 by the external audio device 330, which is formed by a TV set and does not form a part of the hearing system 300. The same hearing system 300 can also be used for other external audio devices, such as a computer or a music entertainment system.

The audio streaming device 320 is further configured to convert the rear sound data into the rear communication signal 17Q and to provide the wireless rear communication signal 170 to the first and second hearing aid 110, 110', which are worn by the user and previously shown in FIG. 1. The rear communication signal 170 is provided via a short range wireless link, in this embodiment a Bluetooth link, between the audio streaming device 320 and the first and second hearing aids 110, 110'.

The hearing system 200 of this embodiment forms a large circle 340 in which the surround sound, initially provided by the external audio device 330, can be perceived with the same high quality by the user.

In an embodiment not shown, the loudspeakers in front of the user are not connected to the audio streaming device, but directly connected to the external audio device. In this embodiment, the hearing system is just formed by the two hearing aids, which form the binaural hearing aid device, and by the audio streaming device. Consequently, the audio streaming device of this embodiment is just configured to receive the rear sound data and not the front sound data.

In an embodiment not shown, three loudspeakers are used in front of the user, wherein a first loudspeaker provides the left sound channel, a second loudspeaker provides the right sound channel, and a third loudspeaker provides the center sound channel. In further embodiments, more than three loudspeakers are used in front of the user.

In another embodiment not shown, a single loudspeaker is used to provide the acoustic front tone. In this embodiment, the acoustic front tone preferably comprises the sub-woofer or central channel, comprising low frequency information.

Figure 4:
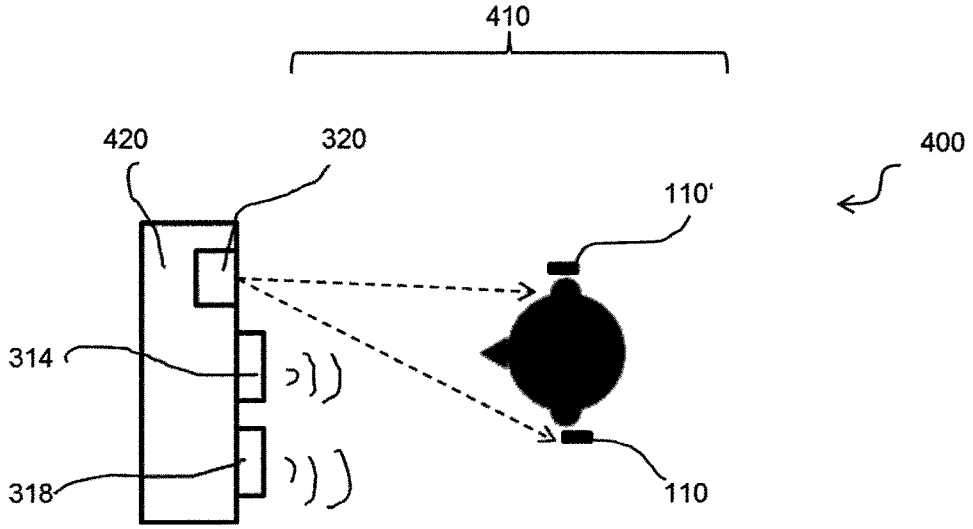
FIG. 4 illustrates an embodiment of an audio surround system according to a third aspect of the invention.

In FIG. 4, an embodiment of the hearing system is shown, wherein the loudspeakers do not form a part of the hearing system, since they are integrated into the external device and not directly connected to the audio streaming device.

FIG. 4 illustrates an embodiment of an audio surround system 400 according to a third aspect of the invention.

The audio surround system 400 comprises a further embodiment of the hearing system 410 according to the second aspect of the invention, and a further external audio device 420.

The external audio device 420 of the illustrated embodiment is a TV set, and the first and the second loudspeakers 314, 318 are physically integrated in the external audio device, as well as the audio streaming device 320 of the hearing system 410.

In this embodiment, the external audio device 420 is configured to provide the rear signal data to the audio streaming device 320, while the front signal data is directly provided to the first and second loudspeaker 314, 318. In embodiments as shown in FIG. 3, the front signal data is also provided to the audio streaming device and further transmitted to the first and second loudspeaker.

In embodiments not shown, the external audio device is a computer or a music entertainment system.

Figure 5:
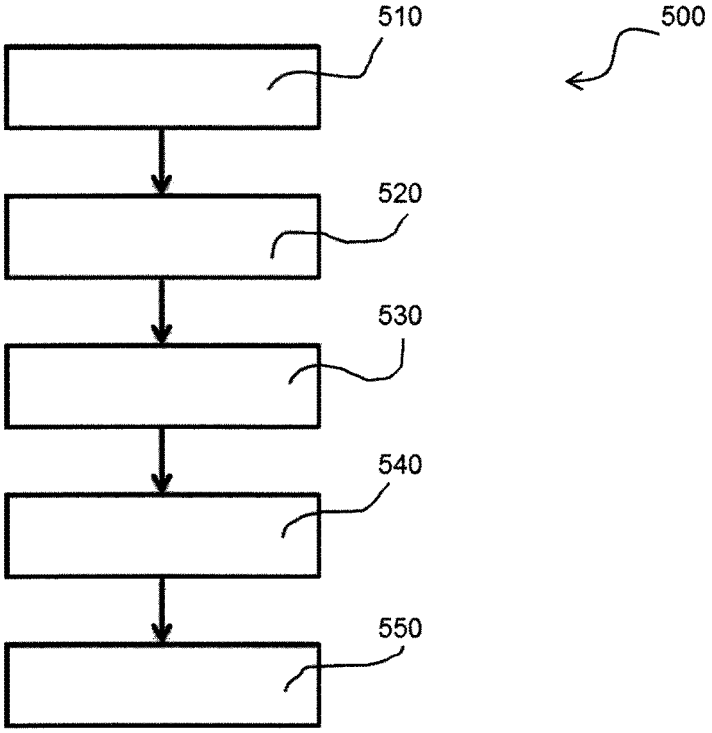
FIG. 5 illustrates an embodiment of a method for providing a surround sound to the ears of a user according to a fourth aspect of the invention.

FIG. 5 illustrates an embodiment of a method 500 for providing a surround sound to the ears of a user according to a fourth aspect of the invention.

The method 500 comprises the steps that are discussed in the following.

A first step 510 comprises an attaching of a first hearing aid in or on a left ear of a user and a second hearing aid in or on a right ear of the user.

A further step 520 is formed by receiving an acoustic front tone, indicative of a front part of a surround sound, by the respective hearing aids and by converting the acoustic front tone into an electric front signal.

In another step 530 of the method 500, a wireless rear communication signal, indicative of a rear part of the surround sound, is received by the respective hearing aids and the rear communication signal is converted into an electric rear signal.

The next step 540 comprises a determining of a processed electric rear signal with respect to the electric front signal, by adjusting a time delay between the electric rear signal and the electric front signal and by adjusting a sound level of the electric rear signal according to a sound level of the electric front signal. Furthermore, the step 540 contains a providing of a processed surround signal, consisting at least of the processed electric rear signal.

In the last step 550 of the method 500 the processed surround signal is converted into an acoustic output and the acoustic output is provided to the respective ear of the user.

Step 540 is performed such that the time delay and the sound level of the electric rear signal provided to the left ear is different from the time delay and the sound level of the electric rear signal provided to the right ear. Thereby the acoustic output of the first hearing aid and of the second hearing aid form the rear part of the surround sound.

The steps 520 to 550 are typically repeated as long as the rear communication signal is provided or in predefined time intervals. Typically, the steps 520 to 550 are performed by the first and second hearing aid separately.

It is intended that the structural features of the devices described above, either in the detailed description and/or in the claims, may be combined with steps of the method, when appropriately substituted by a corresponding process.

As used, the singular forms "a," "an," and "the" are intended to include the plural forms as well (i.e. to have the meaning "at least one"), unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will also be understood that when an element is referred to as being "connected" or "coupled" to another element, it can be directly connected or coupled to the other element but an intervening elements may also be present, unless expressly stated otherwise. Furthermore, "connected" or "coupled" as used herein may include wirelessly connected or coupled. As used herein, the term "and/or" includes any and all combinations of one or more of the associated listed items. The steps of any disclosed method is not limited to the exact order stated herein, unless expressly stated otherwise.

It should be appreciated that reference throughout this specification to "one embodiment" or "an embodiment" or "an aspect" or features included as "may" means that a particular feature, structure or characteristic described in connection with the embodiment is included in at least one embodiment of the disclosure. Furthermore, the particular features, structures or characteristics may be combined as suitable in one or more embodiments of the disclosure. The previous description is provided to enable any person skilled in the art to practice the various aspects described herein. Various modifications to these aspects will be readily apparent to those skilled in the art, and the generic principles defined herein may be applied to other aspects.

The claims are not intended to be limited to the aspects shown herein, but is to be accorded the full scope consistent with the language of the claims, wherein reference to an element in the singular is not intended to mean "one and only one" unless specifically so stated, but rather "one or more." Unless specifically stated otherwise, the term "some" refers to one or more.

REFERENCE NUMBER LIST

100 Binaural hearing aid device
110 First hearing aid
110' Second hearing aid
115, 115' Vent
120, 120' Microphone unit
125, 125' Electric front signal
130, 130' Receiver unit

135, 135' Electric rear signal
140, 140' Audio processor
142, 142' Localizing unit
145, 145' Processed surround signal
150, 150' Speaker unit
155, 155' Acoustic output
160 Acoustic front tone
170 Rear communication signal
180, 180' Detector unit
200 Prior art hearing system
211, 212, 213 214, 215 Prior art loudspeaker
220 External device
230 Prior art circle
300 Hearing system
314 First loudspeaker
318 Second loudspeaker
320 Audio streaming device
330 External audio device
340 Circle
400 Audio surround system
410 Further hearing system
420 Further external audio device
500 Method
510, 520, 530 540, 550 Steps of the method

The invention claimed is:

1. A binaural hearing aid device, comprising a first hearing aid adapted to be worn in or on a left ear of a user of the binaural hearing aid device and a second hearing aid, adapted to be worn in or on a right ear of the user of the binaural hearing aid device, respectively, wherein each hearing aid comprises a microphone unit, arranged and configured to receive an acoustic front tone, indicative of a front part of a surround sound, and to convert the acoustic front tone into an electric front signal;

a receiver unit, configured to receive a wireless rear communication signal, indicative of a rear part of the surround sound, and to convert the rear communication signal into an electric rear signal;

an audio processor, configured to receive the electric front signal and the electric rear signal and to determine a processed electric rear signal with respect to the electric front signal, by adjusting a time delay between the electric rear signal and the electric front signal and by adjusting a sound level of the electric rear signal according to a sound level of the electric front signal, and to provide a processed surround signal, comprising at least the processed electric rear signal;

a speaker unit, configured to receive the processed surround signal, to convert the processed surround signal into an acoustic output and to provide in case of use the acoustic output to the respective ear of the user, wherein the audio processor of the first hearing aid is configured to adjust the time delay and the sound level of the electric rear signal differently than the audio processor of the second hearing aid, such that the combined acoustic output of the first hearing aid and of the second hearing aid forms the rear part of the surround sound.

2. The binaural hearing aid device according to claim 1, wherein the first and second hearing aid each comprise a vent forming an acoustic sound passage for feeding external sounds to a respective eardrum of the user.

3. The binaural hearing aid device according to claim 1, wherein the first and second hearing aid each comprise a localizing unit, which is connected to the audio processor, and which is configured to receive a location information and to determine a distance between the respective hearing aid and a source of the acoustic front tone, and wherein the audio processor is further configured to adjust the electric rear signal according to the determined distance.

4. The binaural hearing aid device according to claim 3, wherein the microphone unit of the first and second hearing aid comprises a respective microphone array, which is arranged and configured to determine and provide the location information, or wherein the localizing unit is further configured to receive and compare the electric front signal and the electric rear signal to determine a generic Head Related Transfer Function, and to determine the location information using the Head Related Transfer Function.

5. The binaural hearing aid device according to claim 1, wherein the first and second hearing aids comprise a respective detector unit, which is arranged and configured to detect a change of a position of the respective hearing aid and to initiate an adjustment of the electric rear signal upon a detection of a change of the position.

6. The binaural hearing aid device according to claim 1, wherein the processed surround signal is a combination of the processed electric rear signal and the electric front signal, such that the acoustic output of the first hearing aid and of the second hearing aid each forms a combination of the rear part and the front part of the surround sound.

7. A hearing system, comprising a binaural hearing aid device according to claim 1 and an audio streaming device, wherein the audio streaming device is arranged and configured to receive rear sound data from an external audio device, to convert the rear sound data into the rear communication signal and to provide the rear communication signal wirelessly.

8. The hearing system according to claim 7, wherein the rear communication signal is provided via a short range wireless link, such as a Bluetooth link, between the audio streaming device and the first and second hearing aid.

9. The hearing system according to claim 7, further comprising at least one front loudspeaker, and wherein the audio streaming device is further configured to receive front sound data from the external audio device and to transmit the front sound data to the at least one front loudspeaker, and wherein the front loudspeaker is configured to convert the front sound data into the acoustic front tone.

10. An audio surround system, comprising the hearing system according to claim 7 and the external audio device, and wherein the external audio device is a TV set, a computer, or a music entertainment system.

11. An audio surround system according to claim 10, wherein the audio streaming device forms a part of the external audio device.

12. Method for providing a surround sound to the ears of a user, comprising the steps of attaching a first hearing aid in or on a left ear of a user and a second hearing aid in or on a right ear of the user receiving an acoustic front tone, indicative of a front part of a surround sound, by the respective hearing aids and converting the acoustic front tone into an electric front signal;

receiving a wireless rear communication signal, indicative of a rear part of the surround sound, by the respective hearing aids and converting the rear communication signal into an electric rear signal;

determining a processed electric rear signal with respect to the electric front signal, by adjusting a time delay between the electric rear signal and the electric front signal and by adjusting a sound level of the electric rear signal according to a sound level of the electric front signal, and providing a processed surround signal, consisting at least of the processed electric rear signal;

converting the processed surround signal into an acoustic output and providing the acoustic output to the respective ear of the user, wherein the time delay and the sound level of the electric rear signal provided to the left ear is different from the time delay and the sound level of the electric rear signal provided to the right ear, such that the acoustic output of the first hearing aid and of the second hearing aid form the rear part of the surround sound.

13. Method according to claim 12, further comprising determining of a distance between the respective hearing aid and a source of the acoustic front tone, and wherein the adjustment of the electric rear signal is provided according to the determined distance.

14. Method according to claim 12, further comprising a detection of a change of a position of the respective hearing aid and an initiation of the adjustment of the electric rear signal upon a detection of a change of the position.

15. Method according to claim 12, further comprising as first steps providing an acoustic front tone;

providing rear sound data, converting the rear sound data into the rear communication signal and providing the rear communication signal wirelessly.

16. The binaural hearing aid device according to claim 2, wherein the first and second hearing aid each comprise a localizing unit, which is connected to the audio processor, and which is configured to receive a location information and to determine a distance between the respective hearing aid and a source of the acoustic front tone, and wherein the audio processor is further configured to adjust the electric rear signal according to the determined distance.

17. A hearing system, comprising a binaural hearing aid device according to claim 2 and an audio streaming device, wherein the audio streaming device is arranged and configured to receive rear sound data from an external audio device, to convert the rear sound data into the rear communication signal and to provide the rear communication signal wirelessly.

18. A hearing system, comprising a binaural hearing aid device according to claim 3 and an audio streaming device, wherein the audio streaming device is arranged and configured to receive rear sound data from an external audio device, to convert the rear sound data into the rear communication signal and to provide the rear communication signal wirelessly.

19. A hearing system, comprising a binaural hearing aid device according to claim 4 and an audio streaming device, wherein the audio streaming device is arranged and configured to receive rear sound data from an external audio device, to convert the rear sound data into the rear communication signal and to provide the rear communication signal wirelessly.

20. A hearing system, comprising a binaural hearing aid device according to claim 5 and an audio streaming device, wherein the audio streaming device is arranged and configured to receive rear sound data from an external audio device, to convert the rear sound data into the rear communication signal and to provide the rear communication signal wirelessly.

* * * * *